US010414583B2

(12) United States Patent
Mallett et al.

(10) Patent No.: US 10,414,583 B2
(45) Date of Patent: Sep. 17, 2019

(54) METHOD AND APPARATUS FOR ORGANIC WASTE COLLECTION IN MULTI-UNIT RESIDENTIAL BUILDINGS

(71) Applicant: Plastics Solutions Canada Inc., Surrey (CA)

(72) Inventors: Eric Mallett, Vancouver (CA); Philip D. Ragan, Garden Bay (CA); Richard M. Freeman, Delta (CA); Geoffrey B. Woolley, Pitt Meadows (CA)

(73) Assignee: EcoSafe Zero Waste Inc., Surrey (CA)

( * ) Notice: Subject to any disclaimer, the term of this patent is extended or adjusted under 35 U.S.C. 154(b) by 87 days.

(21) Appl. No.: 15/314,042

(22) PCT Filed: May 29, 2015

(86) PCT No.: PCT/CA2015/050499
§ 371 (c)(1),
(2) Date: Nov. 25, 2016

(87) PCT Pub. No.: WO2015/179986
PCT Pub. Date: Dec. 3, 2015

(65) Prior Publication Data

US 2017/0190508 A1 Jul. 6, 2017

Related U.S. Application Data

(60) Provisional application No. 62/004,542, filed on May 29, 2014.

(51) Int. Cl.
*B65F 1/14* (2006.01)
*B65F 1/06* (2006.01)
(Continued)

(52) U.S. Cl.
CPC ..... *B65F 1/0093* (2013.01); *B65F 1/0006* (2013.01); *B65F 1/06* (2013.01);
(Continued)

(58) Field of Classification Search
None
See application file for complete search history.

(56) References Cited

U.S. PATENT DOCUMENTS 5,042,687 A 8/1991 McKinley
6,578,730 B2 6/2003 Trunsky
(Continued)

OTHER PUBLICATIONS

International Search Report dated Aug. 4, 2015 issued on PCT/CA2015/050499.
(Continued)

*Primary Examiner* — Gene O Crawford
*Assistant Examiner* — Ayodeji T Ojofeitimi
(74) *Attorney, Agent, or Firm* — Bruce M. Green; Oyen Wings-Green & Mutala LLP

(57) ABSTRACT

Effective systems for separating, collecting and transferring organic waste from multi-unit residential buildings to deliver to composting centers are described which facilitate the reduction of contamination of the organic waste with non-compostable plastic bags. This is accomplished both by ensuring that the residents are constantly provided with compostable replacement bags for their kitchen caddies after each delivery of a bag by the resident to the recycling room, and through consistent marking that reminds residents of the system's requirements.

22 Claims, 19 Drawing Sheets

(51) Int. Cl.
*B65F 1/00* (2006.01)
*B65F 3/00* (2006.01)

(52) U.S. Cl.
CPC ..... *B65F 1/1473* (2013.01); *B65F 3/00* (2013.01); *B65F 1/1468* (2013.01); *B65F 2001/1489* (2013.01); *B65F 2210/1125* (2013.01); *B65F 2210/1128* (2013.01); *B65F 2250/105* (2013.01)

(56) References Cited

U.S. PATENT DOCUMENTS

2005/0206700 A1* 9/2005 Jones ..... B41J 2/17593 347/88
2006/0163257 A1* 7/2006 Golbert ..... B65F 1/062 220/495.07
2010/0025415 A1* 2/2010 Bichler ..... A47F 9/043 221/1
2010/0170913 A1* 7/2010 Shoshani ..... A47K 10/426 221/44
2011/0055734 A1* 3/2011 Borst ..... A63F 13/795 715/757
2012/0279981 A1* 11/2012 Thomas ..... B65D 83/0805 221/1

OTHER PUBLICATIONS

International Preliminary Report on Patentability dated Sep. 26, 2016 issued on PCT/CA2015/050499.
http://www.armaoh.00v.uk/recycling/food-waste—Armagh City (2011)
http://www.armagh.gov.uk/wp-content/uploads/2013/12/Bryson-Armagh-food-Sept13-web.pdf.
https://www.facebook.com/230380027069450/photos/a.279255742181878.61864.230380027069450/473713992736051/?type=1&theater—K9 Community Clean—(Sep. 14, 2013).

* cited by examiner

Notice:

Composting and Recycling Outreach

Wednesday, April 23rd

10am- 1pm

We are starting a composting program on Wednesday, April 23rd. You will be receiving a Kitchen Caddy along with an informational flyer that explains the program details. It's now as easy as 1, 2, 3-

1. TAKE a new bag from the compost bag dispenser to line your Kitchen Caddy

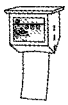

2. Fill your Kitchen Caddy with the approved compostable items

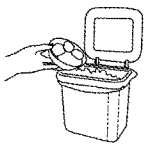

3. Drop your full compost bag in your designated compost cart

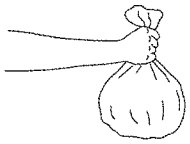

Thank you,

Building Management

FIG. 9

METHOD AND APPARATUS FOR ORGANIC WASTE COLLECTION IN MULTI-UNIT RESIDENTIAL BUILDINGS

CROSS REFERENCE TO RELATED APPLICATION

The present application claims the benefits, under 35 U.S.C.§ 119(e), of U.S. Provisional Application Ser. No. 62/004,542 filed May 29, 2014 which is incorporated herein by this reference.

TECHNICAL FIELD

The invention relates to the field of urban waste recycling and more particularly to municipal organic waste collection systems in multi-unit residential buildings. The invention further relates to the field of food scrap recycling in commercial food preparation areas such as food stores, restaurants, commercial kitchens and hospitality settings.

BACKGROUND

Urban recycling programs over recent decades have been very successful in the recycling of certain waste materials from residential units, particularly paper, plastics, beverage containers and the like, due to the roadside blue box programs. Recycling of organic wastes, such as kitchen food waste, food-soiled paper, garden clippings etc. has been more challenging. Such waste is separated, collected and delivered to composting centres. However composting centres must reject material which is contaminated with non-compostable plastic, metal or glass. Hence a great deal of care and attention is required in the separation and collection of the compostable material by the individuals involved. This is challenging for home-owners for a number of reasons. First the nature of organic waste is such that it attracts vermin and pests, and has strong odors. There is a tendency therefore to solve the problem by including organic waste with other non-recycled refuse. Also since the bag which is used to transfer the organic waste can only be included with the collected compostable material if such bag itself is compostable, there is a high incidence of the collected material being contaminated with non-compostable plastic, and a reluctance both on the part of users to use the system and composting centres to accept material from untrustworthy sources.

Currently many municipalities require separation of organic waste by single-family residential home-owners. An important factor is that the organic waste contains considerable water and is therefore a large portion, by weight, of the waste produced by a household, and landfills and other waste processing centres charge for processing by weight. However municipalities have been unwilling to include multi-unit residential buildings in such programs for a number of reasons. Such buildings are generally responsible for their own waste collection and pay for same on the basis of weight. However there is a difficulty in such buildings in ensuring the degree of education and care necessary to avoid contamination of the organic waste with non-compostable plastics or other material. For example, there is a high occurrence of residents of such buildings using non-compostable plastic grocery bags to collect, store and transfer the organic waste due to the cost of compostable bags. This results in much higher waste disposal costs for multi-unit residential buildings.

A further problem faced in operating organic waste recycling in multi-unit residential buildings relates to the "transition gap". This is the distance between each multi-unit residential dwelling unit and a central deposit location for organic waste. In current systems residents transport the loose organic waste in a bucket to the central deposit area. The result is spills and leaks. Without proper containment, organic waste being transported to the central deposit area can spill or leak in common hallway areas and/or stairwells. Further if using an unlined organic waste collection kitchen bin to transport the organic waste to the central deposit area, residents must make a two-way trip, returning their soiled bin to their dwelling unit, rather than dropping the waste off on the way out of the building.

There is therefore a need for improved systems for separating, collecting and transferring organic waste from multi-unit residential buildings to deliver to composting centres which reduce contamination of the organic waste with non-compostable material. There is a further need for systems which can address the transition gap problem in operating organic waste recycling in multi-unit residential buildings.

As noted, traditional material and organic recycling through composting contribute to environmentally sustainable practices which are now mandated in many communities. Many landfills are nearing capacity and programs to divert materials from landfills must be put in place to extend the life of the landfill to avoid closures. New landfills are very difficult to site and permit, particularly near urban areas. Zero Waste Programs serve to mitigate the landfill development problem. Local and regional governments are therefore now implementing zero waste plans and are specifically calling for business community involvement in organic waste (food scraps) diversion and material recycling.

Diverting organic material and food scraps from landfills contributes to the reduction of greenhouse gas, a major contributor of global warming. Landfills account for 17% of methane gas emissions and are a major source of human-related greenhouse gas emissions in North America. Methane is a potent greenhouse gas that results when organic materials such as food scraps biodegrade in a landfill setting. In 2010, 250 million tons of municipal waste was generated in the USA alone. Organics, food scraps and recyclable materials account for as much as two-thirds of the waste currently being disposed of in landfills. Less than 2.8% of the 85 million tons of food scraps were diverted in 2010. Food scraps remain the largest discarded material category in the US municipal waste stream.

There is a significant cost advantage to diverting organic waste and food scraps from the landfill. Landfill tipping fees may be in excess of $100.00 per ton while commercial compost tipping fees can be as low as $40.00/ton for a savings of $60.00/ton. As an example, large grocery stores produce about 20 tons of waste weekly, of which about 17 tons can be diverted to composting. Multi-store grocery chains can realize significant financial savings by diverting their organic waste and thereby reduce their carbon footprint.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

The present embodiments provide effective systems for separating, collecting and transferring organic waste from multi-unit residential buildings to deliver to composting centres which facilitate the reduction of contamination of the organic waste with non-compostable plastic bags. This is accomplished both by ensuring that the residents are constantly provided with compostable replacement bags for their kitchen caddies after each delivery of a bag by the resident to the recycling room, and through consistent marking that reminds residents of the system's requirements.

According to one embodiment, a system is provided for collecting and transferring organic waste from residential units of a multi-unit residential building to deliver to composting centres which facilitates the reduction of contamination of the organic waste with non-compostable plastic bags by ensuring that the residents are constantly provided with compostable replacement bags for their in-residence receptacles after each delivery of a bag by the resident to a recycling area, the building having one or more common recycling areas where waste material is separated and collected for recycling, the system comprising: i) a plurality of first containers each sized and adapted to be stored in a residential unit of the building for receiving a compostable bag for receiving organic waste; ii) a second container located in a recycling area provided with a compostable bag adapted to receive compostable bags from the first container; iii) proximate to the second container, a bag dispenser for dispensing compostable bags for the first container; iv) a plurality of replacement compostable bags for dispensing from the dispenser; v) a plurality of compostable bags sized to be received in the second container for receiving compostable bags from said first container; whereby the bag dispenser is provided with an indicator or signal to alert a system operator that replacement of bags in the dispenser is necessary, whereby each resident who deposits a bag of organic waste from the first container into the second container is provided with an empty compostable bag from the dispenser to replace the bag thereby deposited.

According to a further embodiment there is provided a bag dispenser for dispensing bags for collecting and transferring organic waste from a facility to deliver to composting centres which facilitates the reduction of contamination of the organic waste with non-compostable plastic bags by ensuring that users are constantly provided with compostable replacement bags, the container comprising: i) a hollow container comprising a plurality of compartments each sized and adapted to receive a roll of compostable bags for receiving organic waste; ii) wherein the container is provided with a plurality of slots, each associated with one of the compartments and sized to permit the end of a roll of compostable bags to extend therethrough; whereby the bag dispenser is provided with a plurality of unique indicators, each associated with one of the compartments to indicate the size of bag dispensed from said one of said compartments. The indicators can be associated with the receptacles using the size of bag which is dispensed from the compartment bearing that indicator.

In addition to the exemplary aspects and embodiments described above, further aspects and embodiments will become apparent by reference to the drawings and by study of the following detailed descriptions.

BRIEF DESCRIPTION OF DRAWINGS

Exemplary embodiments are illustrated in referenced figures of the drawings. It is intended that the embodiments and figures disclosed herein are to be considered illustrative rather than restrictive.

FIG. 9 is an example of a pre-program notice; and

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
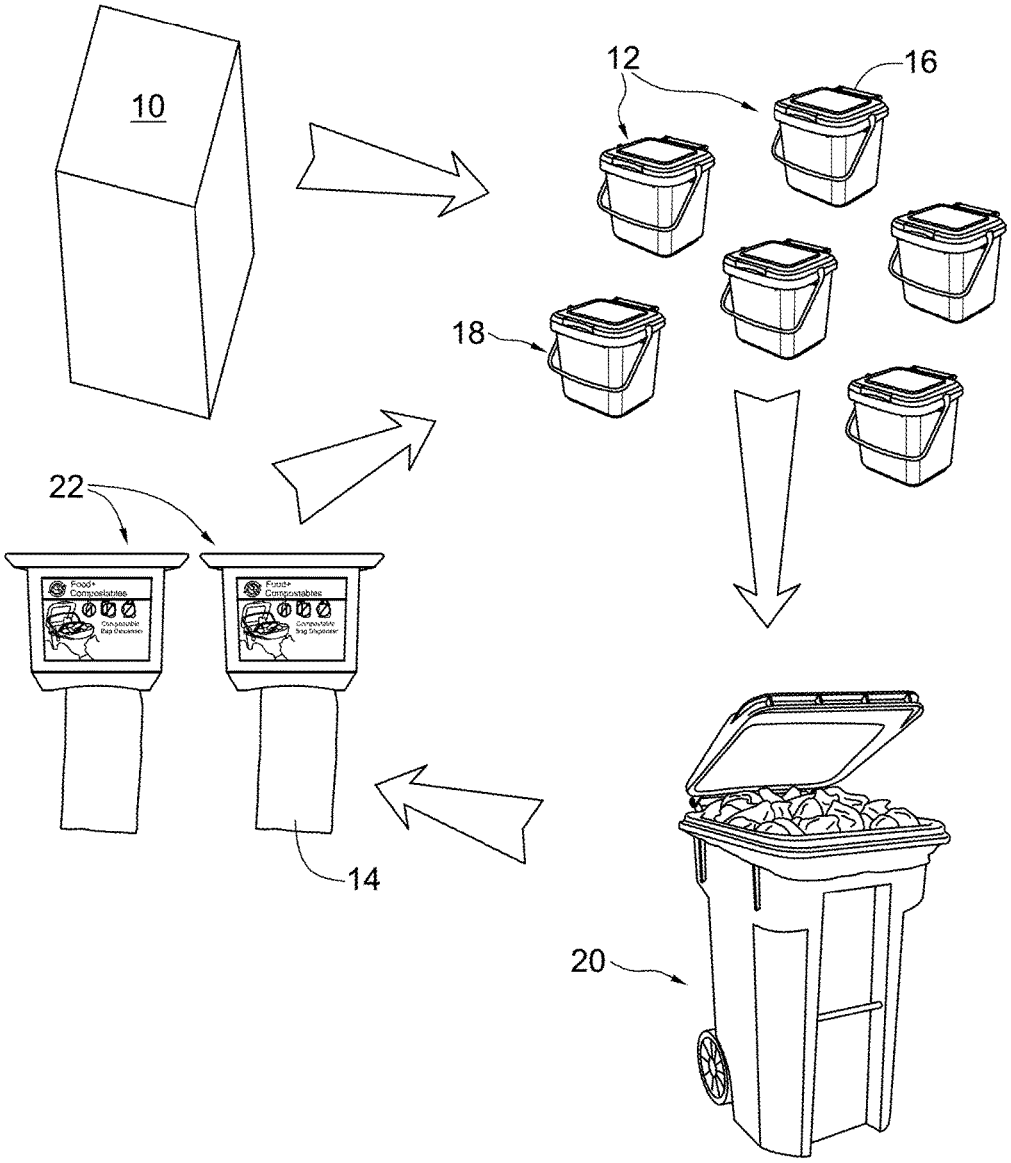
FIG. 1 is a flowchart illustrating an embodiment of the invention.

With reference to FIG. 1, a multi-unit residential building 10, such as an apartment or condo building, dormitory, co-operative, hotel or the like has multiple residential units each of which may have a kitchen or food preparation area, or otherwise generates organic waste. Each building 10 has one or more common areas where waste material is separated and collected for recycling. This may take the form of centralized bins located on each floor, or bins located in a recycling room on each floor, or a single central recycling area located at ground level and which may receive waste material by garbage chutes or may require residents to walk the material to bins. Generally an on-site manager, janitorial staff or third party contractor will be responsible for emptying individual recycling bins to the final collection containers that are collected by the recycling service providers. Compost is typically collected by a compost hauler who will accept vegetative material, waste organics such as meat, bones or dairy, organic-soiled paper or cardboard, or other identifiably compostable items.

Figure 10:
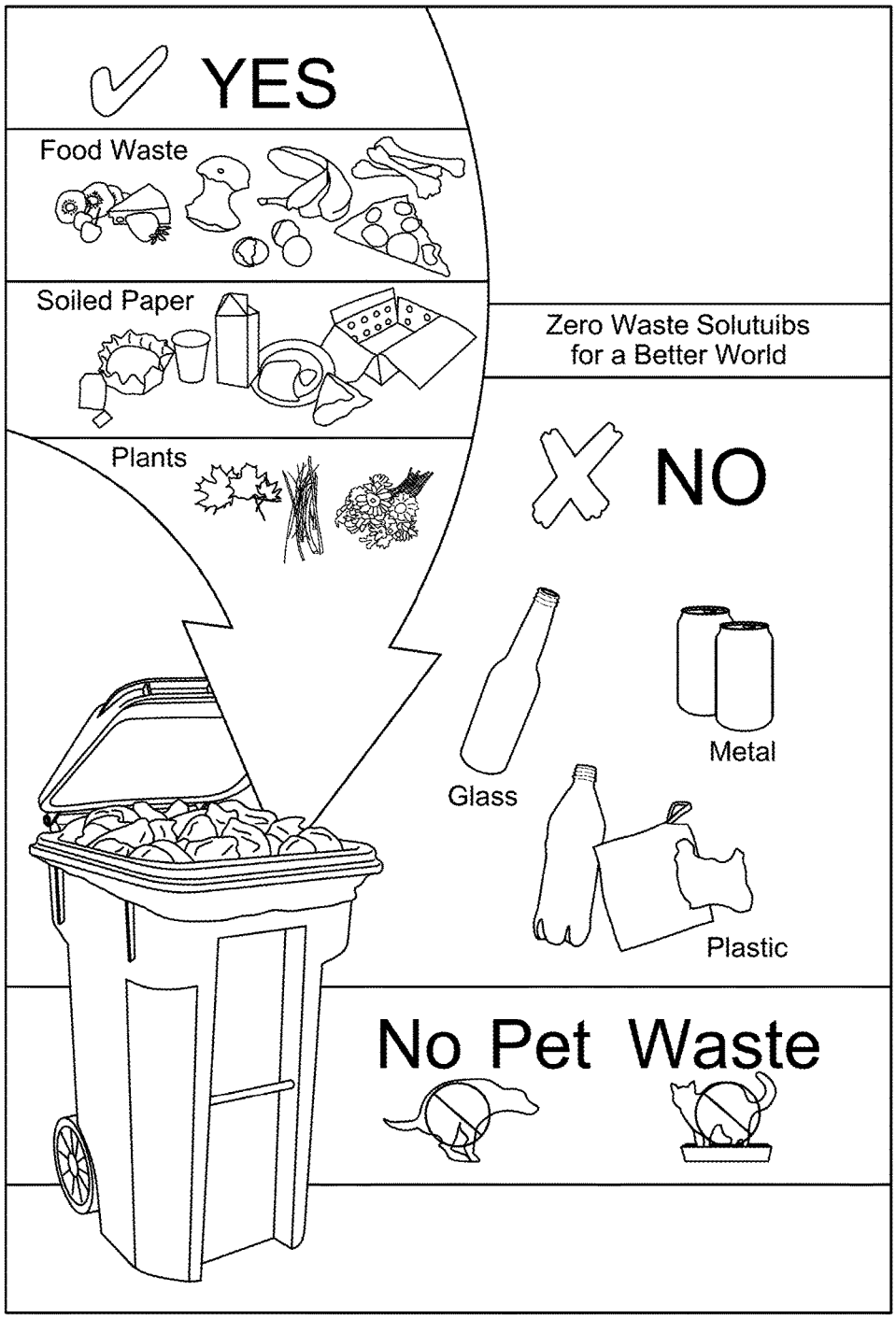
FIGS. 10 and 11 are examples of instruction cards for use in the system.
Figure 11:
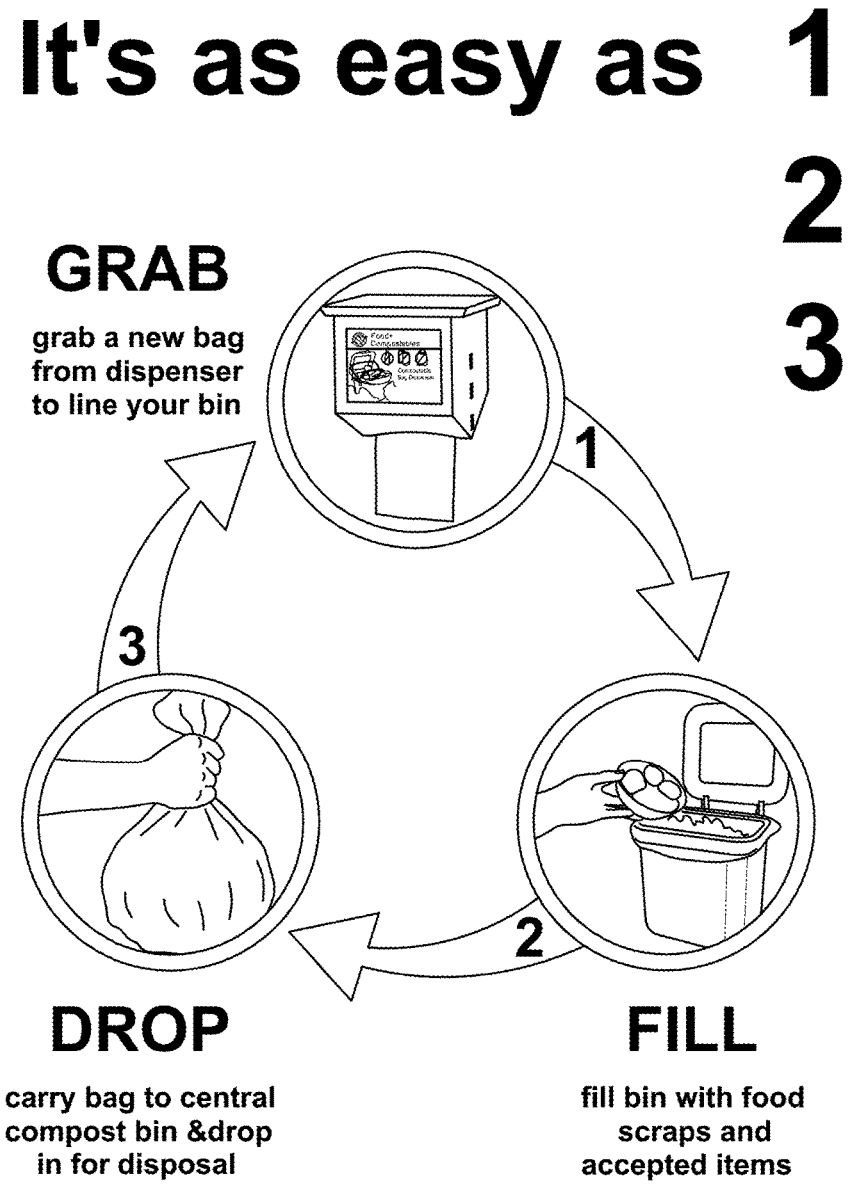

According to the present method, for residents to collect organic waste, a kitchen caddy or bin 12 is provided to each residential unit, preferably along with an information card or cards, for example as shown in FIGS. 10 and 11, explaining the system. The manager may maintain a log book to record which residents have received the kitchen caddies and information cards. If the program is being newly implemented in the building, a Notice as shown in FIG. 9 may be posted or distributed. Each resident initially retrieves from dispenser 22, or is provided initially, a compostable bag 14. The kitchen caddy 12 (shown in FIG. 2) receives compostable plastic bag 14 as a liner. It has a lid 16 on hinge 15, and handle 18. It is placed in an appropriate location in each residential unit, such as under the kitchen sink or on a counter top, to receive food scraps and other compostable organic waste. Each such kitchen caddy used by a family of 4 will typically be emptied about 2 to 3 times a week so each family will require about 2 to 3 bags per week.

An organic waste container or cart 20 for receiving full or partially full bags 14 of organic waste, or unbagged organic waste, is provided in the aforementioned common areas for access by residents of building 10 to collect organic waste collected by individual residents. The resident is able to deposit the compostable bag 14 containing organic waste from kitchen caddy 12 directly into container 20. Container 20 is itself lined with a compostable plastic cart bag 27 (FIG. 3) to permit the compost hauler to haul away the organic waste without soiling of container 20 or leakage of materials. When the appointed pick-up time arrives, container 20 is placed on the street for emptying by the compost hauler, composter or for transfer to the composter by a delivery truck or other means of delivery. Or container 20 may itself be used to transfer the collected organic waste to a larger curbside bin for collection by the hauler.

To ensure that only acceptable compostable bags are used by residents of the building to deposit organic waste in container 20, adjacent to container 20 in the building's common recycling areas are provided one or more dispensers 22 for replacement compostable bags 14. Steps are taken in order to avoid running out of replacement bags at the recycling location because if the resident is unable to obtain a replacement bag, chances are high that a non-compostable bag will be used as the alternative, which will disrupt the proper operation of the system. In order to avoid running out of replacement compostable bags, slots 80 (as in FIG. 8) are strategically cut into each side of single dispenser 22 and double dispenser 60 to provide a visual indication if bag replacement is required. A warning system may be provided in addition or instead with dispensers 22 and 60 which senses when the supply of bags is at a point where new rolls need to be loaded. The warning may be a flashing light, an audible alarm or a wireless signal sent to a caretaker's wireless receiver.

Figure 6:
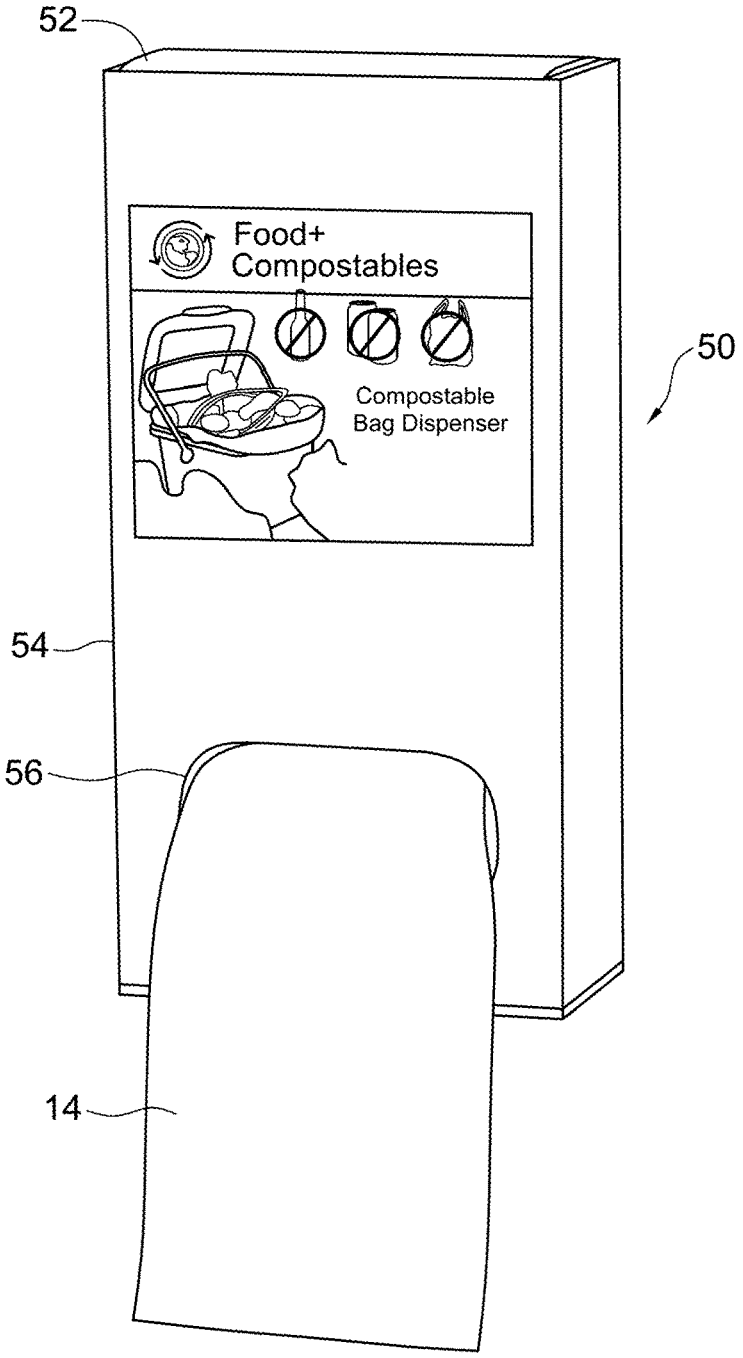
FIG. 6 is a front perspective view of an alternative bag dispenser for use in an embodiment.
Figure 7:
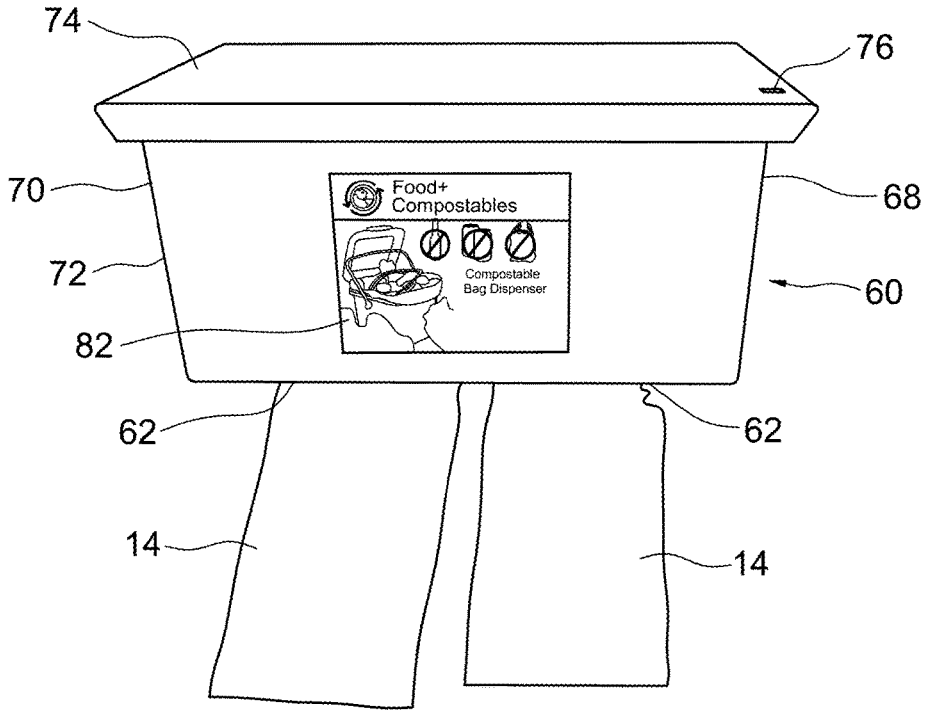
FIG. 7 is a front perspective view of a further alternative bag dispenser for use in an embodiment.

Preferably a double supply of bags is provided by using two dispensers 22 or a double-sided dispenser 60 as shown in FIG. 7, 8. The aforementioned warning system may be provided in one or both of the twin dispensers 22 or dispenser 60 which senses when the supply of bags is below a certain level and issues a warning, whether audible or a flashing light, or sends a wireless signal to a caretaker's email or wireless receiver. By using twin dispensers 22 or a double roll dispenser 60, a roll is replaced whenever one roll is depleted and so a second backup roll is always available to avoid completely running out of replacement bags 14. This also encourages rolls of bags to be fully used, rather than being replaced with unused bags still on the roll. Multiple dispensers 50 loaded with bags packaged in cardboard boxes may also be used as shown in FIG. 6.

Figure 5:
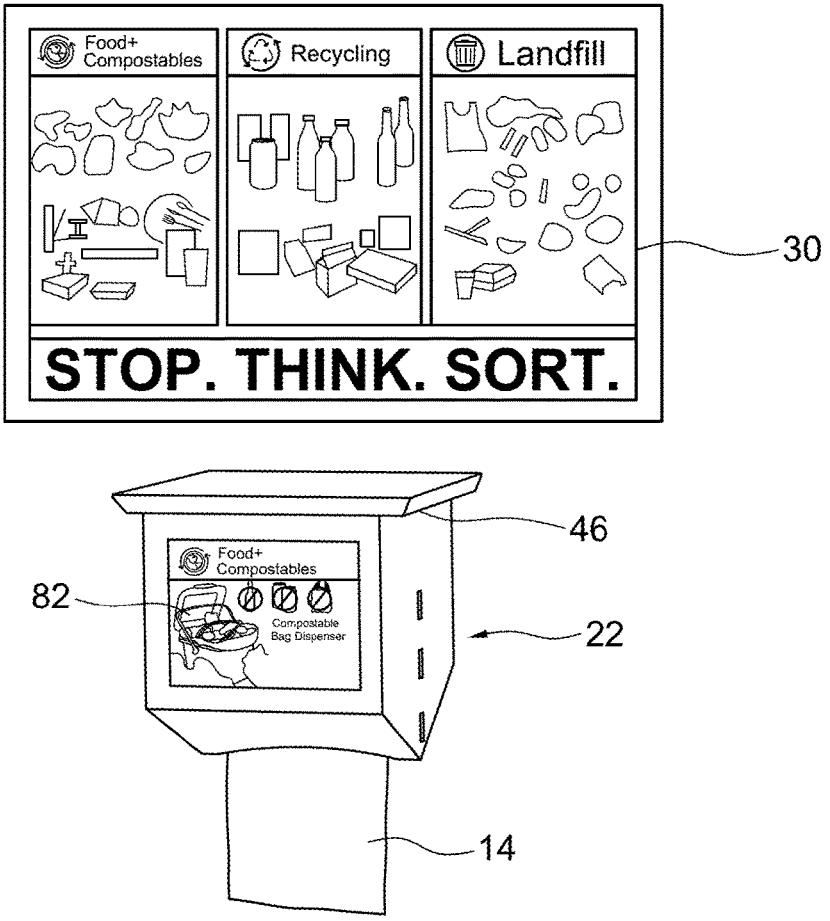
FIG. 5 a front perspective view of an instructional display in association with a bag dispenser for use in the embodiment.

The preferred system also facilitates the reduction of contamination of the collected organic waste through the use of systematic educational and planning components. As shown in FIG. 5, the point of dispensing of replacement compostable bags in the common recycling area is preferably provided with signage 30 to educate the user in the proper separation of recycled organic and inorganic materials. Instructions 82 may also be included on the dispenser bodies 42, 54, 68 and on the inside of lids 16, 25.

The system may also include access to a secure on-line portal page where customers can access and download system components to help with planning, implementation, and ongoing support. System components include, but are not limited to:

- Program Planning
- Detailed Program Start-up Tool Kit
- Full Program Troubleshooting Guide
- System Tool Checklist
- System Tool Order Form
- Sample Waste Audit Forms
- Compost Hauler Comparison Form
- Sample signage and stickers
- Program Implementation
- Resident Program Log
- Resident Composting Champion Award
- Downloadable Educational Outreach Materials including—
- Pre-notification Resident Flyer
- Pre-notification Resident Door Hanger
- Staff Training Guide
- Program Launch Information Card
- New Resident Program Information Flyer
- Resident Report Card
- Training Presentations for Staff and Residents
- Food waste Fact Sheet
- Program Support
- Product ordering guides
- On-line ordering account set up guide
- Program evaluation tool Preferably the bags used in the system are certified 100% compostable plastic and meet suitable standards of compostability such as ASTM #D6400 Standard Specifications for Compostable Products, and comply with Biodegradable Products Institute (BPI) specifications or other comparable certification. Preferably the bags 14 are marked with a distinctive mark and colouring, such as the mark ECOSAFE as shown, so that composters immediately recognize that the waste is being transported in certified compostable plastic bags. The preferred bag size is about 2.5 gallons (9.46 1.).

Figure 2:
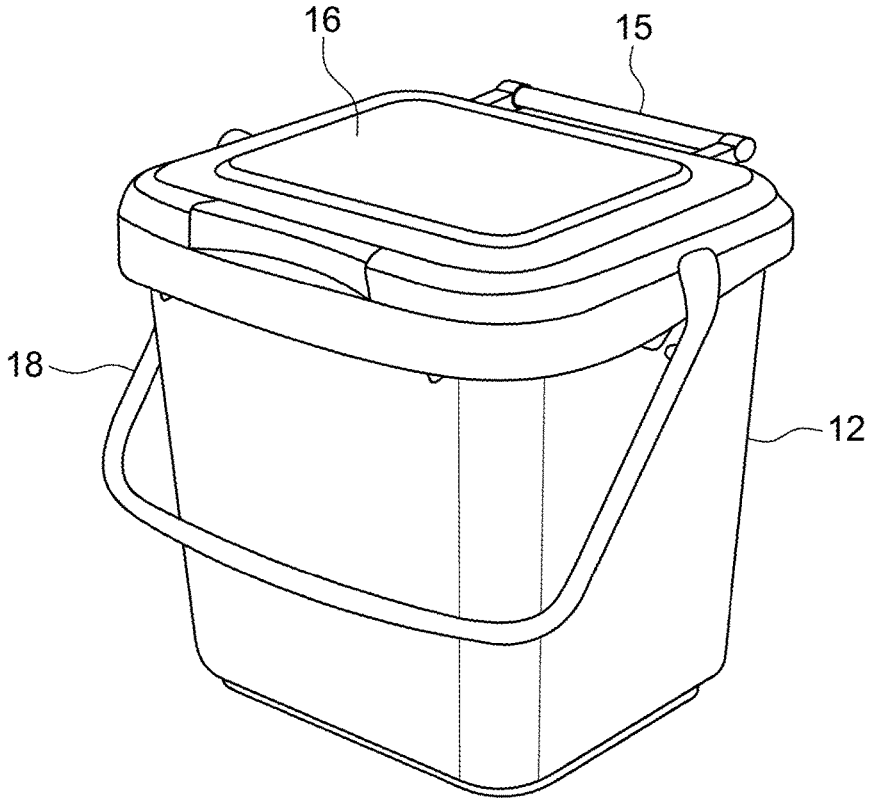
FIG. 2 is a front perspective view of a kitchen caddy for use in the embodiment.

Preferably the kitchen caddy 12 as shown in FIG. 2 has a capacity of about 2 gallons (7.5 1.) or less. Due to the reduced contamination of the organic waste with greater assurance of the use of compostable bags and the effectiveness of the educational components of the system, the composting raw material is more valuable and desirable for the composter. Preferably the caddy 12 is also marked with the same distinctive mark and colouring as bags 14, such as the mark ECOSAFE as shown, so that the residents are reminded that the special compostable bags 14 must be used to collect the organic waste.

Figure 3:
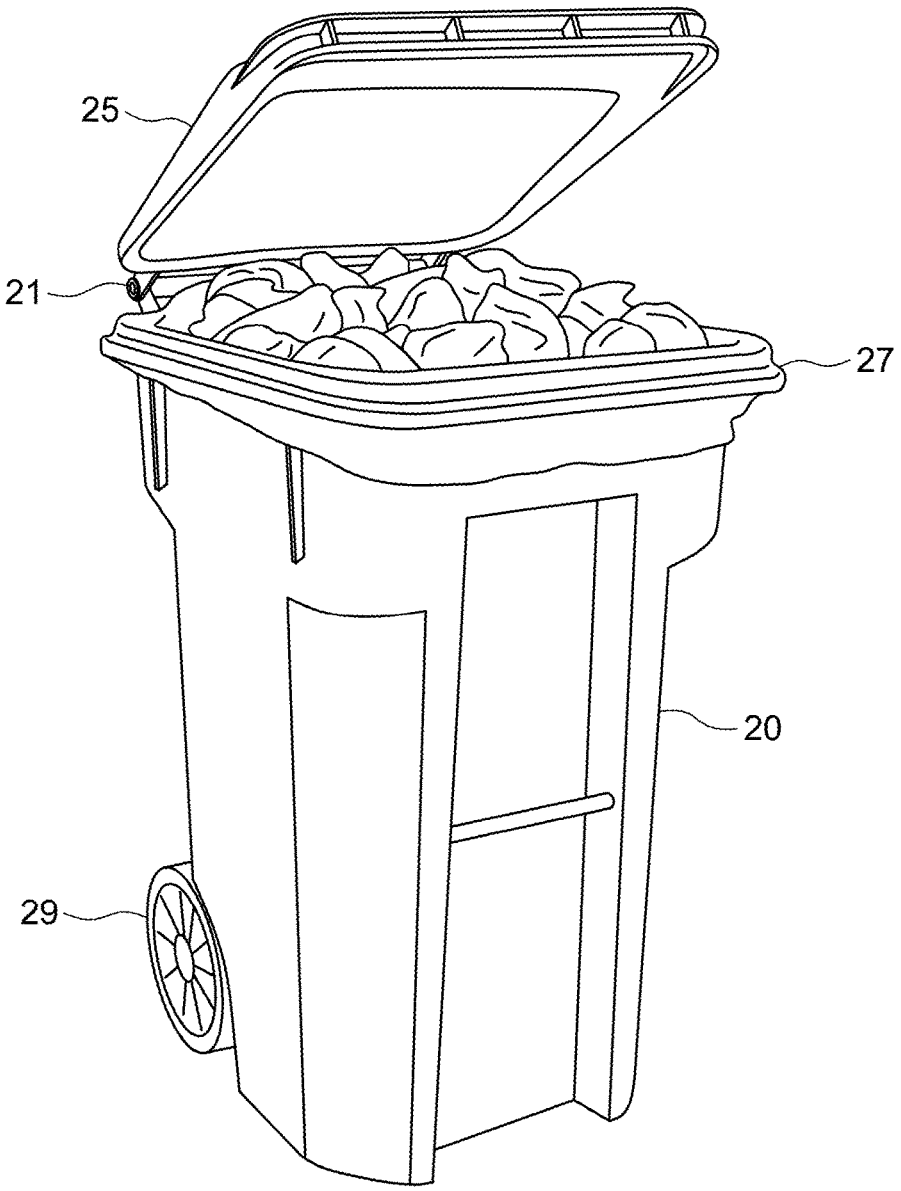
FIG. 3 a front perspective view of a container or cart for receiving full or partially full bags of organic waste.

The curbside container 20 shown in FIG. 3 preferably has a volume of about 6 gallons (23 liters) or greater. It may have wheels 29, a lid 25 which closes tightly or seals, and hinge 21. It is made of materials sufficiently durable to withstand heavy weight and machine handling. However the lid 25 is sufficiently manageable to allow residents to easily open it to deposit organic waste. Preferably the container 20 as well as the compostable bags which line it are also marked with the same distinctive mark and colouring as bags 14, such as the mark ECOSAFE as shown, so that the residents are again reminded that the special compostable bags 14 must be used to collect the organic waste, and so that composters immediately recognize that the waste is being transported in certified compostable plastic bags.

Figure 4:
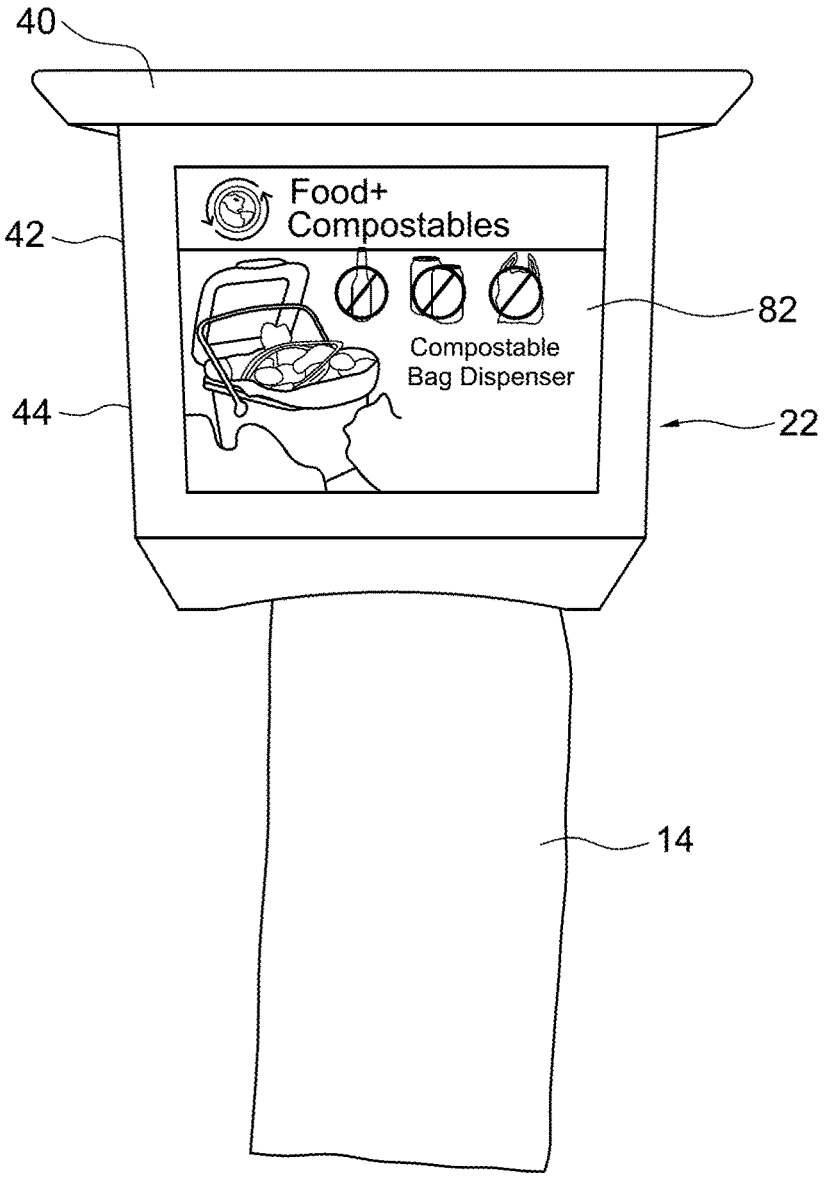
FIG. 4 is a front perspective view of a bag dispenser for use in the embodiment.

Single roll dispenser 22 (FIG. 4) receives a single roll of compostable bags 14 with the end of the roll extending out a slot at the rear of the dispenser 22. Dispenser 22 is preferably constructed of metal, with a hollow body 42 formed of vertical sides 44 and a removable horizontal lid 40 which slides off to receive a roll of bags and when slid shut has an aperture 46 (FIG. 5) which cooperates with an aperture on the side 44 of body 42 of the dispenser to permit a lock to be inserted to lock the roll shut within the dispenser to prevent theft. A roll of bags for such dispenser will typically contain about 325 bags. FIG. 6 shows a dispenser 50 for loading with a single carton 52 of compostable bags 14 numbering typically about 90 or 120 in which the carton 52 is received in hollow plastic body 54 which has a front slot 56 for dispensing the bags 14 from a slot in carton 52.

Figure 8:
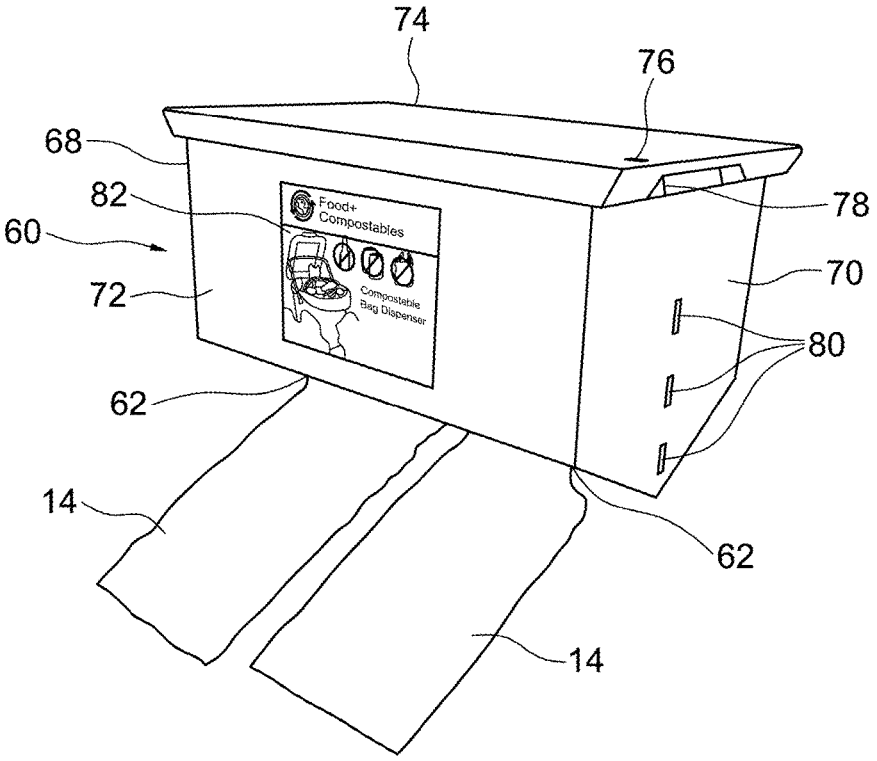
FIG. 8 is a top right perspective view of the bag dispenser shown in FIG. 7.

FIGS. 7 and 8 illustrate a double roll dispenser 60. Dispenser 60 is also preferably constructed of metal, with a hollow body 68 formed of vertical sides 70, 72 and a removable horizontal lid 74 which slides off to receive two rolls of bags and when slid shut has an aperture 76 which cooperates with an aperture 78 on the side 70 of the dispenser to permit a lock to be inserted to lock the rolls shut within the dispenser to prevent theft. The lower surface is a metal plate having two slots 62 through which the ends of the two rolls of bags extend for dispensing at the rear of the dispenser. A central dividing wall within hollow body 68 may be used to separate the two rolls of bags.

Figure 12:
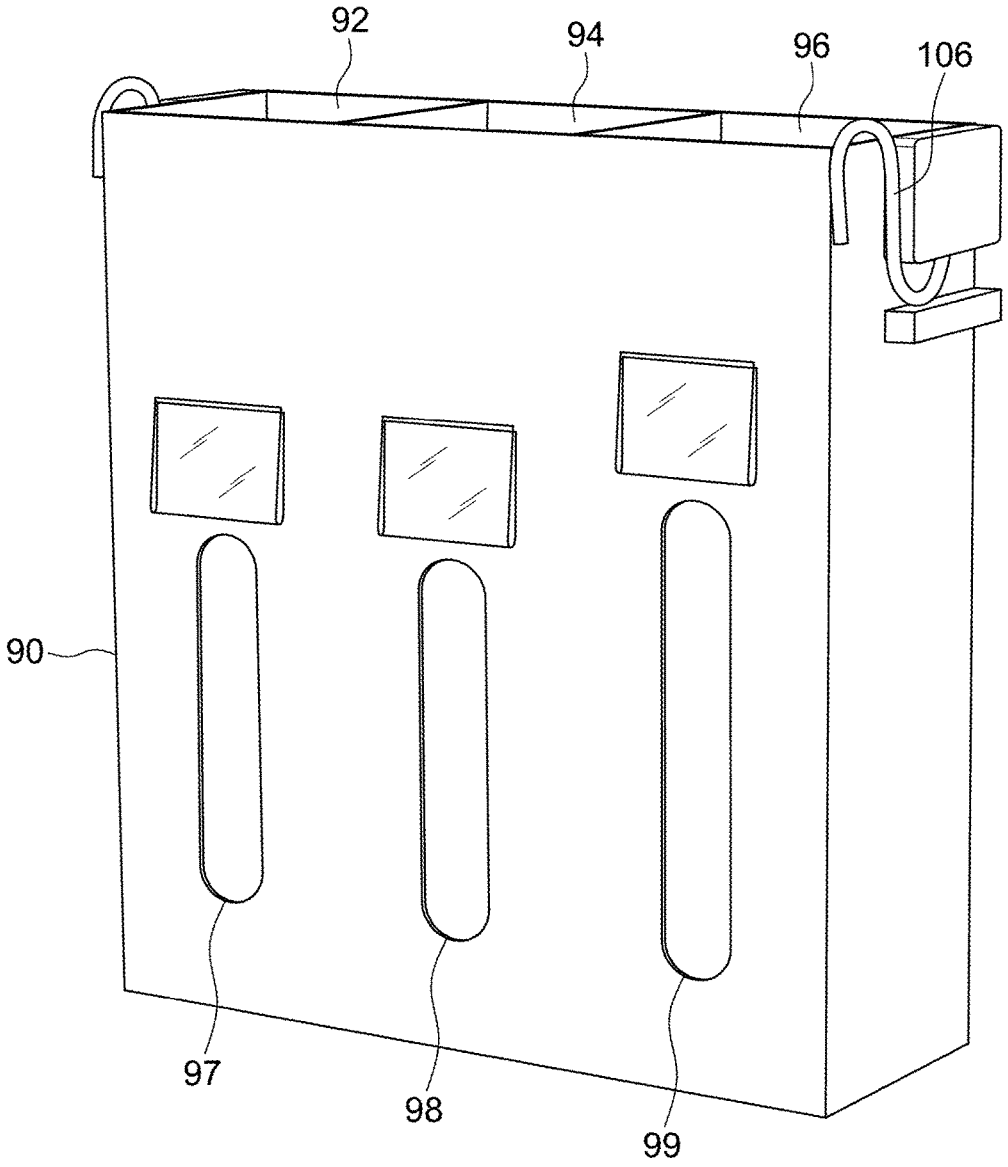
FIG. 12 is a front perspective view of a further embodiment of the bag dispenser having 3 compartments with bag openings and with mounting hooks stored.
Figure 13:
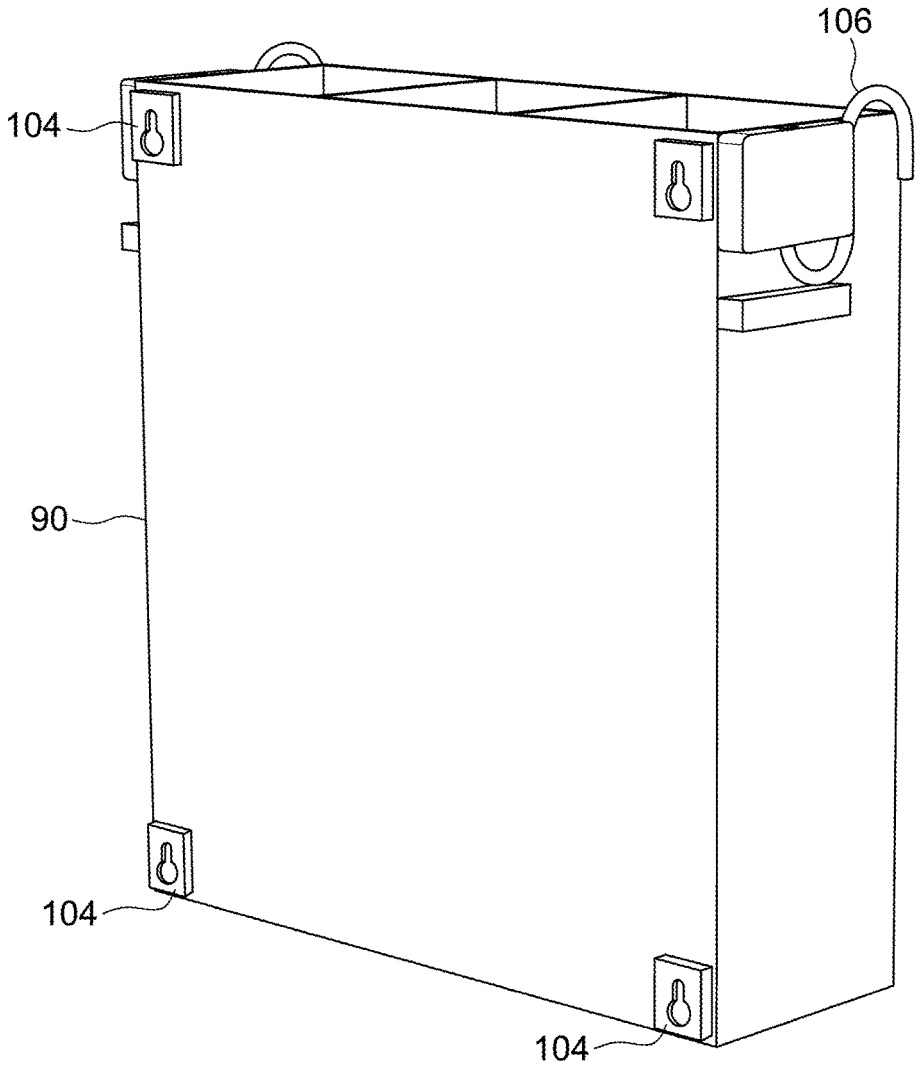
FIG. 13 is a rear perspective view of the bag dispenser shown in FIG. 12, illustrating the dispenser back with wall mounting adapters visible.
Figure 14:
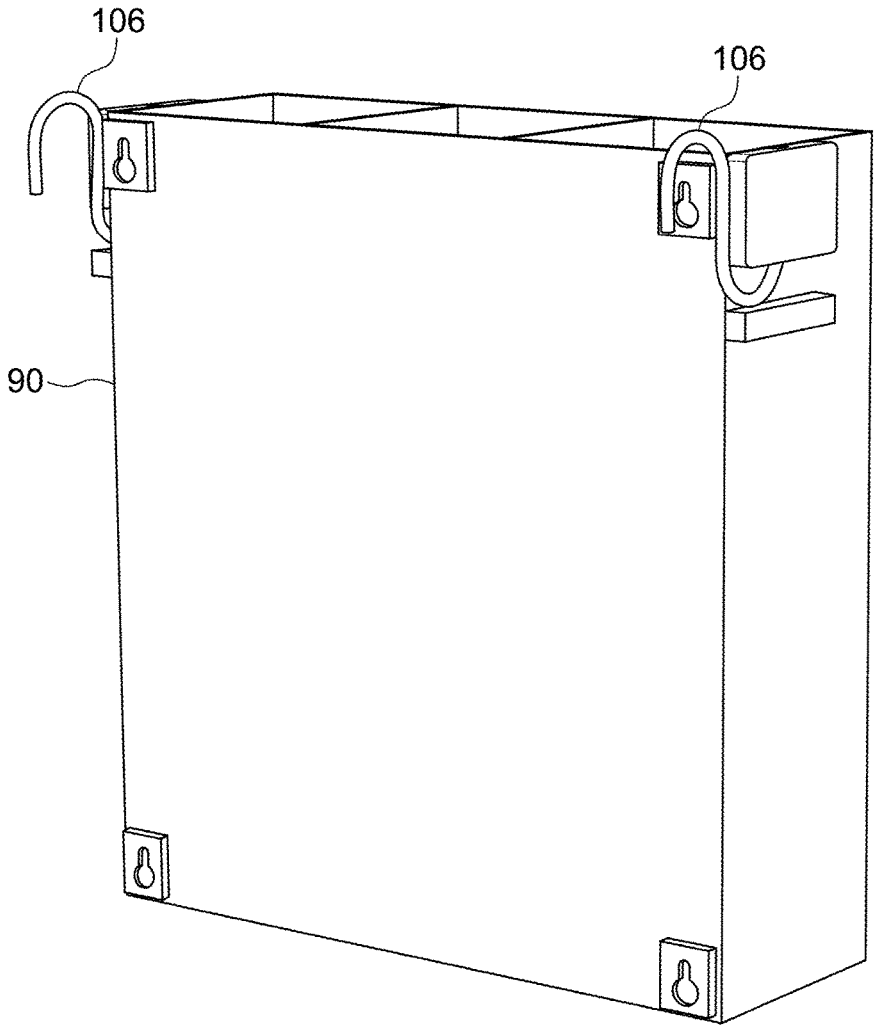
FIG. 14 is a rear perspective view of the bag dispenser shown in FIG. 12 with mounting hooks deployed.
Figure 15:
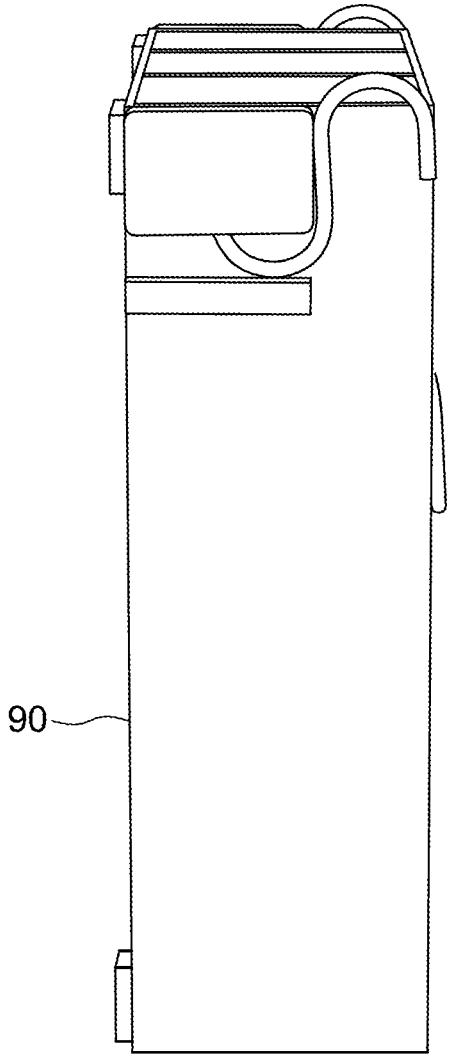
FIG. 15 is a side perspective view of the bag dispenser shown in FIG. 12 with mounting hooks stored.
Figure 16:
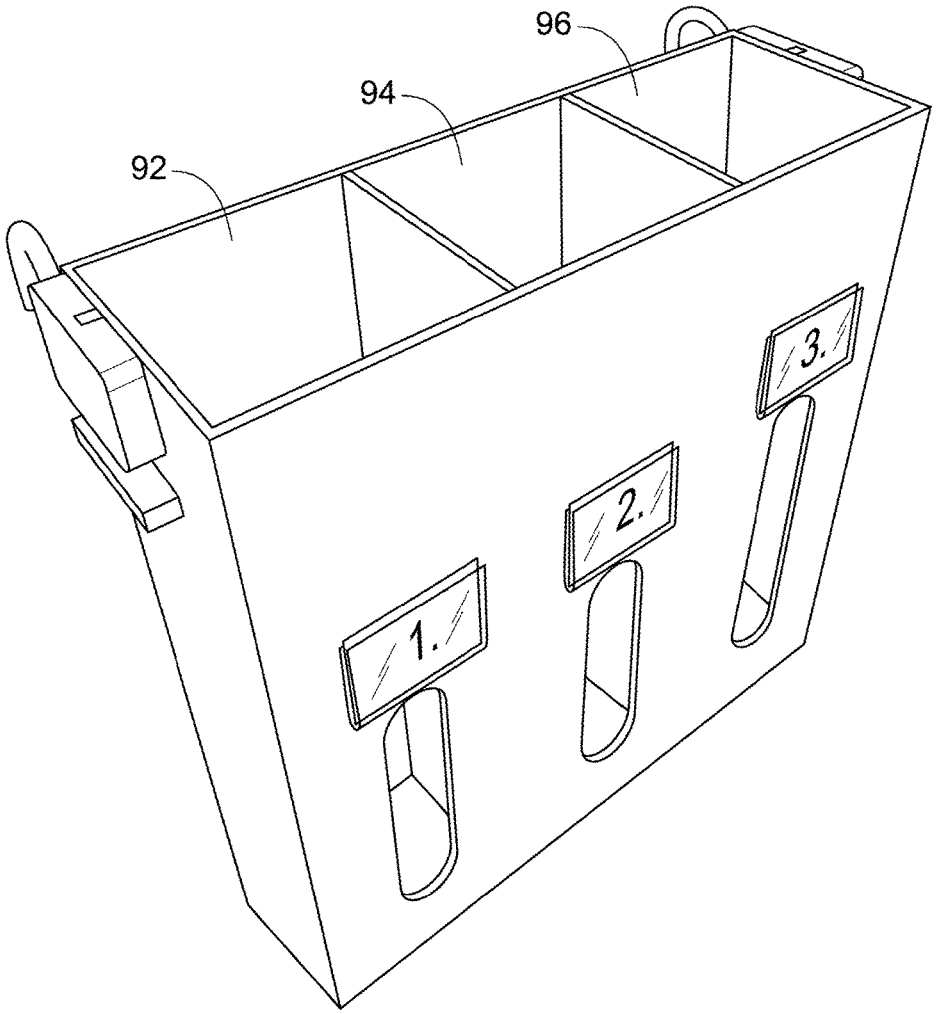
FIG. 16 is a top front perspective view of the bag dispenser shown in FIG. 12, showing 3 compartments with numbered bag openings and mounting hooks deployed.
Figure 17:
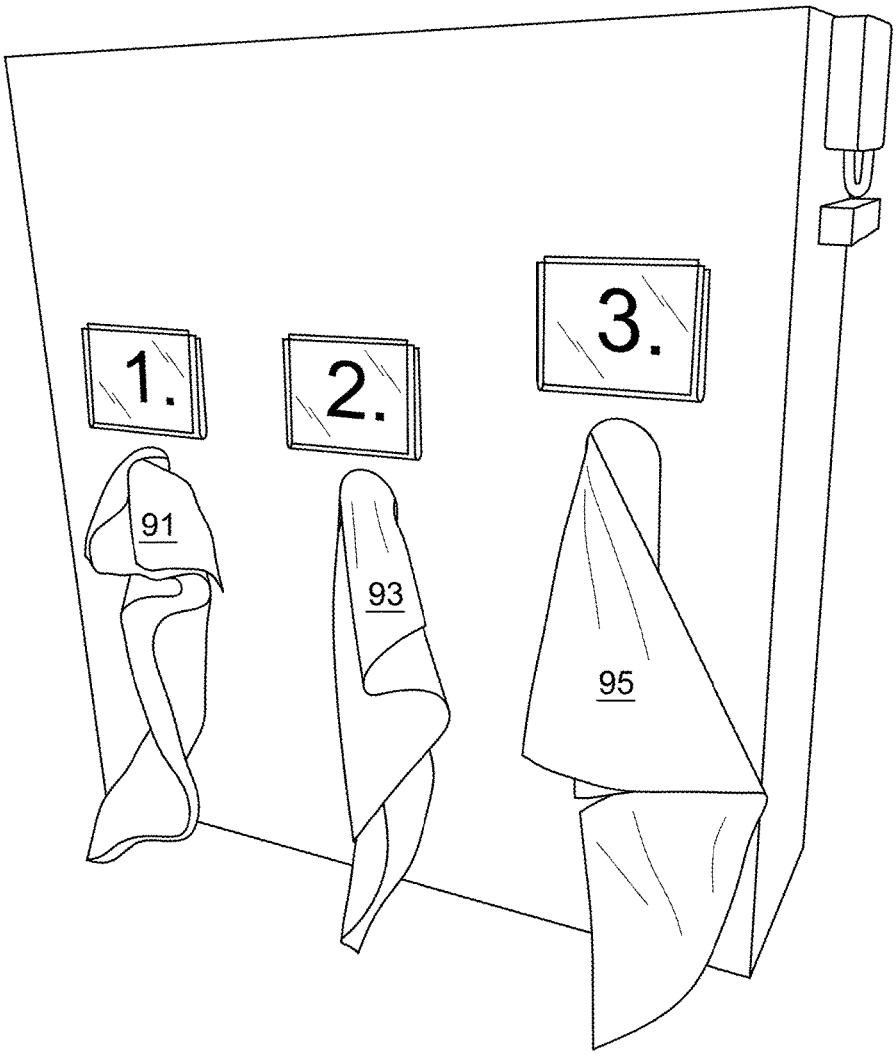
FIG. 17 is a front perspective view of the bag dispenser shown in FIG. 16 having rolls of bags loaded for dispensing.
Figure 18:
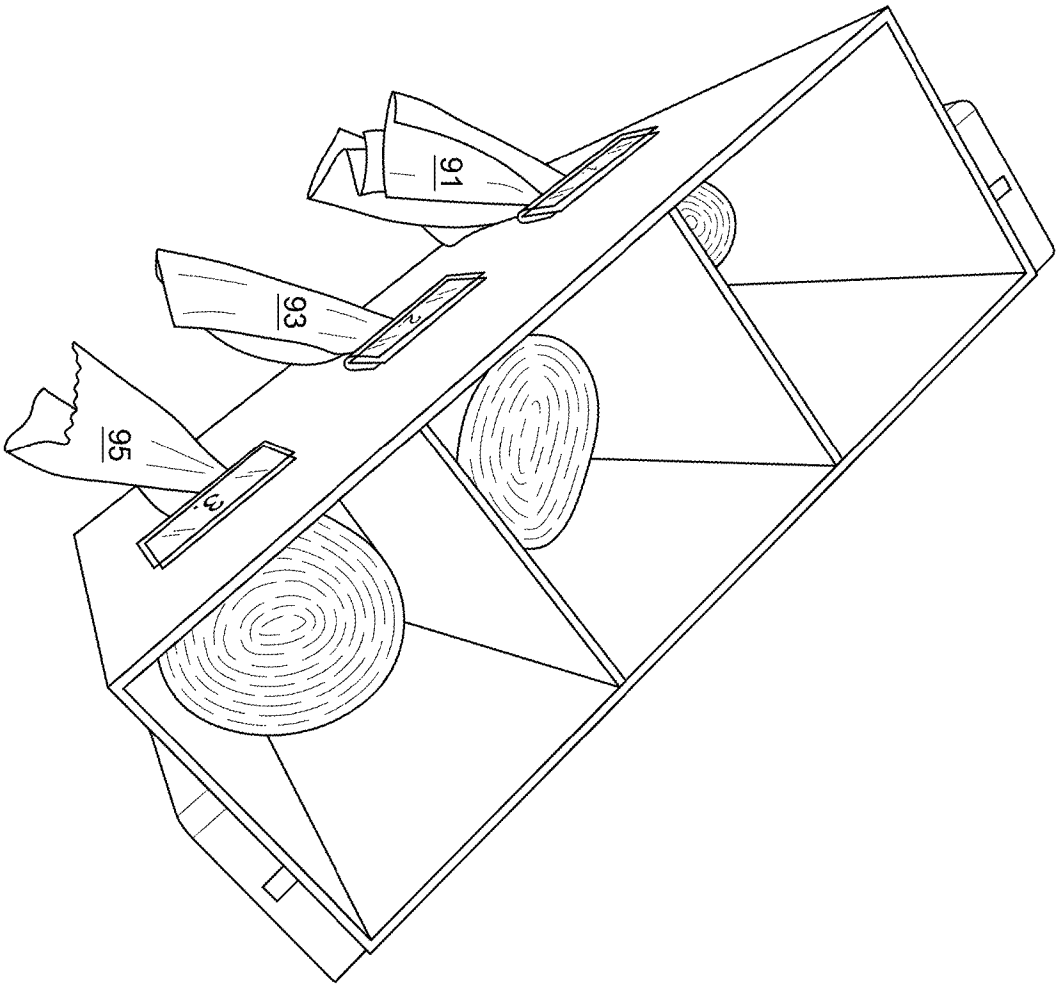
FIG. 18 is a top perspective view of the bag dispenser shown in FIG. 17.

FIG. 12 discloses a further embodiment directed to food scrap recycling in commercial food preparation areas such as food stores, restaurants, commercial kitchens and hospitality settings. Commercial kitchens will normally have two or three different sized bins in use in their facility and require an easy, simple method of ensuring the correct bag is used in the correct bin. The food service wall-mounted dispenser system shown in FIG. 12 provides the facility with a solution to ensure the correct sized bag is easily and readily available. The wall mounted dispenser 90 is designed with three compartments 92, 94, 96 to carry 3 different sized compostable bags, in rolls 91, 93, 95 of ten to fifteen bags each, used to line the three different sized waste bins 101, 102, 103 (FIG. 19) used by the facility. Bags are dispensed through slots 97, 98, 99 sized according to the size of bags to be dispensed. Dispenser 90 is mounted in a convenient location in the facility. Large facilities may use several bag dispensers. Each of the three compartments of the dispenser is numbered, such as by 1, 2 or 3 or other unique and pre-determined numbering or labelling based on the size of the bags used (FIG. 16).

An example of a typical size for dispenser 90 will be 12 inches in height by 11 inches wide by 3¾ inches deep, with each compartment 92, 94, 96 being about 3⅝ inches wide. Slots 97 and 98 may be about 5 inches in height and 1 inch wide while slot 99 as shown is 6 inches in height and 1 inch wide. Such dimensions of course will vary widely depending on the application and size of bags used.

Figure 19:
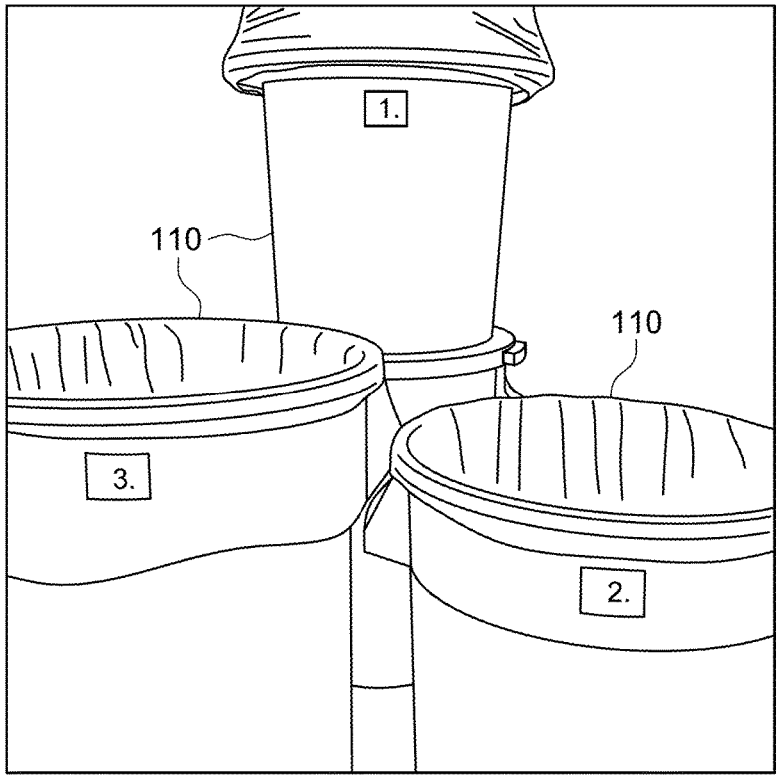
FIG. 19 is a perspective view showing waste bins for use in the system with bag size indicators attached.

Similarly, the waste bins 110 used by the facility are numbered 1, 2, or 3 as shown in FIG. 19 to indicate what sized bag is used to line the particular bin with the corresponding number. The value to the employee is there is always a correct sized bag available in the wall mounted dispenser without having to go to the storeroom to obtain a new bag. The value to management is that the correct bag is used in each bin. Using a bag too large for a bin increases costs up as larger bags are more costly than smaller bags. The bags are readily available in the work area reducing trips to the stock area to find a bag. The bags are designed to fit the bins snugly to avoid the bag spilling or sloughing into the bin. The mounting site creates a central area in which to mount food scrap recycling educational material. The food service wall-mounted dispenser 90 will increase the food scrap diversion rate in the facility further reducing the need and cost for the more expensive landfill hauling.

The food service dispenser may be provided with adapters 104 for wall mounting as well as rotatable hooks 106 that can be used to rack or shelf mount. The hooks can also allow for mounting on the side of a waste cart for use in food court settings. Preferably all dispensers 22, 50, 60 and 90 are also marked with the same distinctive mark and colouring as bags 14, such as the mark ECOSAFE as shown, so that the residents are again reminded that the special compostable bags 14 must be used to collect the organic waste.

Thus the present systems facilitate the reduction of contamination of the organic waste with non-compostable plastic bags, both by ensuring the residents/users are constantly provided with compostable replacement bags for their kitchen caddies after each delivery of a bag to the recycling room, and through consistent marking that reminds residents of the system's requirements. Savings in waste disposal can thereby be realized by any commercial food preparation areas such as restaurants, commercial kitchens, and hospitality settings. Most commercial food scrap generators collect their organic waste in commercially available waste bins. The operator lines the waste bin with a compostable bag, keeping the bin clean during use and more importantly, after emptying. The bag is simply removed from the bin and the bag along with its contents is disposed of in the facilities' recycling area. The employee then removes the correct sized bag from the wall mounted dispenser 90 and installs a new bag. The use of a compostable bag will ensure the bin remains clean through the operation and consequently, the bins will not require washing.

Further the present system addresses the transition gap problem in operating organic waste recycling in multi-unit residential buildings. Regarding spills and leaks, residents can more safely carry their organic waste from their dwelling unit to the central deposit area in their compostable bag without leaks or spills. Regarding one way trips by using the compostable bag, residents can transport their organic waste from their dwelling unit to the central deposit area in one trip depositing the bag directly into the organics cart. No return trip to their dwelling unit is required so this reduces time spent by one-half.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A method of collecting and transferring organic waste from residential units of a multi-unit residential building to deliver to composting centers which facilitates the reduction of contamination of the organic waste with non-compostable plastic bags, said multi-unit residential building having one or more common recycling areas where waste material is separated and collected for recycling prior to moving outside said multi-unit residential building for collection, said method comprising:

i) providing a first container sized and adapted to be stored in a residential unit of said multi-unit residential building for receiving a first designated compostable bag for receiving organic waste;

ii) providing a second container located in said one or more common recycling areas provided with a second designated compostable bag adapted to receive said first designated compostable bags from said first container;

iii) providing, proximate to said second container, a bag dispenser for dispensing said first designated compostable bags for said first container;

iv) monitoring said dispenser to provide replacement first designated compostable bags for said dispenser in advance of exhausting of said first designated compostable bags from said dispenser;

whereby each resident who deposits a first designated compostable bag of organic waste from said first container into said second container is provided with an empty first designated compostable bag from said dispenser to replace the first designated compostable bag thereby deposited, thereby ensuring that the residents are constantly provided with first designated compostable replacement bags for their first containers after each delivery of a first designated compostable bag by the resident to the recycling area.

2. The method of claim 1 wherein said bag dispenser comprises two independent supplies of said first designated compostable bags.

3. The method of claim 1 wherein two separate bag dispensers of first designated compostable bags are provided proximate to said second container.

4. The method of claim 1 wherein said bag dispenser comprises an electronic sensor for sensing when a supply of bags is depleted.

5. The method of claim 1 wherein said first and second containers, said dispenser and said first and second designated compostable bags are each marked with a distinctive symbol designating an organic waste collection system.

6. The method of claim 1 comprising the further step of providing printed instructional material displayed proximate to said dispensers which informs said residents of the steps to be followed to carry out said method.

7. A system for collecting and transferring organic waste from residential units of a multi-unit residential building to deliver to composting centers which facilitates the reduction of contamination of the organic waste with non-compostable plastic bags by ensuring that the residents are constantly provided with compostable replacement bags for their in-residence receptacles after each delivery of a bag by the resident to a recycling area, said building having one or more common recycling areas where waste material is separated and collected for recycling prior to moving outside said building for collection, said system comprising:

i) a plurality of first containers each sized and adapted to be stored in a residential unit of said building for receiving a first designated compostable bag for receiving organic waste;

ii) a second container located in said one or more recycling areas provided with a second designated compostable bag adapted to receive said first designated compostable bags from said first container;

iii) proximate to said second container, a bag dispenser for dispensing said first designated compostable bags for said first container;

iv) a plurality of replacement first designated compostable bags for dispensing from said dispenser;

v) a plurality of said second designated compostable bags sized to be received in said second container for receiving said first designated compostable bags from said first container;

whereby said bag dispenser is provided with an indicator or signal to alert a system operator that replacement of bags in said dispenser is necessary, whereby each said resident who deposits a said first designated bag of organic waste from said first container into said second container is provided with an empty first designated compostable bag from said dispenser to replace said first designated bag thereby deposited.

8. The system of claim 7 wherein said bag dispenser comprises two independent supplies of said first designated compostable bags.

9. The system of claim 7 wherein two separate bag dispensers are provided proximate to said second container.

10. The system of claim 7 wherein said bag dispenser comprises a vertical slot located to provide a visual indication of the level of said first designated compostable bags in said bag dispenser.

11. The system of claim 7 wherein said bag dispenser comprises an electronic sensor for sensing when a supply of said first designated compostable bags is depleted.

12. The system of claim 7 wherein said first and second containers, said dispenser and said first and second designated compostable bags are each marked with a distinctive symbol designating an organic waste collection system.

13. The system of claim 7 further comprising printed instructional material displayed proximate to said dispensers which informs said residents of the steps to be followed to implement said system.

14. A system for collecting and transferring organic waste from residential units of a multi-unit residential building to deliver to composting centers which facilitates the reduction of contamination of the organic waste with non-compostable plastic bags by ensuring that the residents are constantly provided with compostable replacement bags for their in-residence receptacles after each delivery of a bag by the resident to a recycling area, said building having one or more common recycling areas where waste material is separated and collected for recycling prior to moving outside said building for collection, said system comprising:

i) a plurality of first containers each sized and adapted to be stored in a residential unit of said building for receiving a first designated compostable bag for receiving organic waste;

ii) a second container located in said one or more recycling areas provided with a second designated compostable bag adapted to receive said first designated compostable bags from said first container;

iii) proximate to said second container, a bag dispenser for dispensing said first designated compostable bags for said first container;

iv) a plurality of replacement first designated compostable bags for dispensing from said dispenser;

v) a plurality of second designated compostable bags sized to be received in said second container for receiving said first designated compostable bags from said first container;

whereby said bag dispenser is provided with an indicator or signal to alert a system operator that replacement of said first designated compostable bags in said dispenser is necessary, whereby each said resident who deposits a said first designated compostable bag of organic waste from said first container into said second container is provided with an empty first designated compostable bag from said dispenser to replace the first designated bag thereby deposited.

15. The system of claim 14 wherein said bag dispenser comprises two independent supplies of said first designated compostable bags.

16. The system of claim 14 wherein two separate bag dispensers are provided proximate to said second container.

17. The system of claim 14 wherein said bag dispenser comprises a vertical slot located to provide a visual indication of the level of said first designated compostable bags in said bag dispenser.

18. The system of claim 14 wherein said bag dispenser comprises an electronic sensor for sensing when a supply of said first designated compostable bags is depleted.

19. The system of claim 14 wherein said first and second containers, said dispenser and said first and second designated compostable bags are each marked with a distinctive symbol designating an organic waste collection system.

20. The system of claim 14 further comprising printed instructional material displayed proximate to said dispensers which informs said residents of the steps to be followed to implement said system.

21. A system for collecting and transferring organic waste from a facility to deliver to composting centers which facilitates the reduction of contamination of the organic waste with non-compostable plastic bags by ensuring that users are constantly provided with compostable replacement bags, said system comprising:

i) a plurality of bag dispensers for receiving and dispensing compostable bags of a plurality of sizes for receiving organic waste wherein each of said plurality of bag dispensers comprises a bag dispenser for di sensing bags for collecting and transferring organic waste from a facility to deliver to composting centers which facilitates the reduction of contamination of the organic waste with non-compostable plastic bags by ensuring that users are constantly provided with compostable replacement bags, said container comprising:

a) a hollow container comprising a plurality of compartments each sized and adapted to receive a roll of compostable bags for receiving organic waste;

b) said container provided with a plurality of slots, each associated with one of said compartments and sized to permit the end of a roll of compostable bags to extend therethrough;

whereby said bag dispenser is provided with a plurality of unique indicators, each associated with one of said compartments to indicate the size of bag dispensed from said one of said compartments;

ii) a plurality of containers of a plurality of different sizes each located in a recycling area of said facility, each sized for receiving compostable bags of organic waste of one of said plurality of different sizes;

whereby said plurality of containers is each provided with an indicator corresponding to the indicator on the bag dispenser associated with the compartment for receiving compostable bags having the size suitable for use in said each one of said plurality of containers.

22. The system of claim 21 wherein each said indicator is associated with a receptacle using the size of bag which is dispensed from the compartment bearing that indicator.

* * * * *